US006382919B1

(12) United States Patent
Charron

(10) Patent No.: US 6,382,919 B1
(45) Date of Patent: May 7, 2002

(54) TWO-PHASE IMPELLER WITH CURVED CHANNEL IN THE MERIDIAN PLANE

(75) Inventor: Yves Charron, Longpont sur Orge (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 0 days.

(21) Appl. No.: 09/471,499

(22) Filed: Dec. 23, 1999

(30) Foreign Application Priority Data

Dec. 28, 1998 (FR) ..... 98 16522

(51) Int. Cl.[7] ..... F04D 29/38
(52) U.S. Cl. ..... 416/223 R; 416/243
(58) Field of Search ..... 416/223 R, 243, 416/DIG. 2

(56) References Cited

U.S. PATENT DOCUMENTS 4,652,212 A * 3/1987 Burger et al. ..... 416/DIG. 2
5,375,976 A * 12/1994 Arnaudeau ..... 416/DIG. 2

FOREIGN PATENT DOCUMENTS

| | | |
|---|---|---|
| EP | 0781929 | 7/1997 |
| FR | 2333139 | 6/1977 |
| FR | 2665224 | 1/1992 |
| GB | 2066898 | 7/1981 |

* cited by examiner

*Primary Examiner*—John Kwon
(74) *Attorney, Agent, or Firm*—Antonelli, Terry, Stout & Kraus, LLP

(57) ABSTRACT

An Improved impeller which imparts energy to or receives energy from a multiphase fluid comprising at least one gas phase and at least one liquid phase is disclosed. The impeller comprises an inlet section and an outlet section, at least one flow channel delimited by at least one boss and two successive vanes. The impeller has an axial length Lt and a mean radius of curvature Rh(z), taken in the meridian plane, the radius of curvature Rh(z) being determined over at least part of length Lt so as to limit separation of the phases of said multiphase fluid inside the channel.

24 Claims, 3 Drawing Sheets

TWO-PHASE IMPELLER WITH CURVED CHANNEL IN THE MERIDIAN PLANE

BACKGROUND OF THE INVENTION

1. Field of the Invention

The invention is an improvement to two-phase helical mixed flow impellers used in compression or expansion devices.

The invention notably applies to compression helical axial flow impellers such as those described in the Assignee's French Patent Applications 2,333,139, 2,471,501 and 2,665,224, wherein the fluid occurs in the form of a flow in a substantially cylindrical shell.

The invention can also apply to expansion impellers where energy transfer occurs from the fluid to the rotor.

2. Description of the Prior Art

The prior art notably describes helical axial flow type impellers comprising a cylindrical open outer shell and a circular inner shell in the meridian plane, closed by a boss.

SUMMARY OF THE INVENTION

The invention relates to an improved impeller which imparts energy to or receives energy from a multiphase fluid comprising at least one gas phase and at least one liquid phase, the impeller comprising an inlet section and an outlet section, at least one flow channel defined by at least one boss and two successive vanes. The impeller of the invention has an axial length Lt and a mean radius of curvature Rh(z) (taken in the meridian plane), radius of curvature Rh(z) being determined over at least part of length Lt to limit separation of the phases of the multiphase fluid inside the channel.

The terms multiphase (or two-phase) compression or multiphase (or two-phase) pumping are used indiscriminately hereafter.

In the description hereafter

"meridian plane of an impeller" designates any plane passing through the axis of rotation, "radial plane of an impeller" designates any plane perpendicular to the axis of rotation, "channel of the impeller", is defined by at least two successive vanes, an inner wall and an outer shell.

The expression "multiphase fluid" designates hereafter:

either a -single-phase gaseous or exclusively liquid fluid in which a gas is totally dissolved, or a multiphase fluid comprising notably a liquid phase and a gas phase, possibly solid particles such as sand, or viscous particles such as hydrate agglomerates. The liquid phase can consist of several liquid of different natures, and the gas phase can similarly consist of several gases of different natures.

The mean radius of curvature Rh(z) is for example determined from a known initial radius of curvature by implementing at least the following stages:

a value $Z_0$ is selected on the axial position, the corresponding value of Anc(z) is known, a starting value At_max=At_max_I valid for all the values of z is selected, Ac(z) is calculated:

the known value of Anc(z) is compared with the value of At_max, a) Anc(z)<=At_max, then Ac(z) can have any value ranging between 0 and At_max−Anc(z) with $$Rh(z) = -\frac{(W \sin\beta)^2 \cos\gamma}{Ac(z)}$$

and one of these values is selected, b) Anc(z)>At_max, then Ac(z)=At_max−Anc(z), with $$Rh(z) = -\frac{(W \sin\beta)^2 \cos\gamma}{Ac(z)}$$

c) the curvature and the slope are determined from the impeller inlet to the impeller outlet by starting from point T(ZO), T, is obtained at the inlet, corresponding to an angle γ1, and $T_2$ is obtained at the impeller outlet, corresponding to an angle γ2, It is determined if the angle y, corresponding to slope T(z), ranges between −90 and +90 degrees; if the angle becomes less than −90 degrees or greater than 90 degrees at any point, u value At_max_1 is decreased and calculation of Ac(z) is reiterated until an angle value belonging to a given [γ1; γ2] range is obtained.

The value corresponding to the minimum Anc($Z_0$) value can be selected as the initial value of $Z_0$.

The values of angles γ1 or γ2 are for example selected to be equal or different.

According to one embodiment, the impeller is provided with an additional element placed on the outer shell of the vanes to limit leakage between the inlet and the outlet of the impeller, the element being situated for example at least at the high-pressure end of the impeller.

The invention also relates to a method for manufacturing an impeller as described above. The method comprises at least the following steps:

The initial radius of curvature of the impeller being known, a value $Z_0$ is selected on the axial position, the corresponding value of Anc(z) being known, a starting value At_max=At_max_1 valid for all the values of z is selected, Ac(z) is calculated:

the known value of Anc(z) is compared with the value of At_max, a) Anc(z)<=At_max, then Ac(z) can have any value ranging between 0 and At_max−Anc(z), with $$Rh(z) = -\frac{(W \sin\beta)^2 \cos\gamma}{Ac(z)}$$

and one of these values is selected, b) Anc(z)>At_max, then Ac(z)=At_max−Anc(z) with $$Rh(z) = -\frac{(W \sin\beta)^2 \cos\gamma}{Ac(z)}$$

c) the curvature and the slope are determined from the impeller inlet to the impeller outlet by string from point T($Z_0$), $T_1$ is obtained at the inlet, corresponding to an angle γ1, and $T_2$ is obtained at the impeller outlet, corresponding to an angle γ2, It is determined if the angle γcorresponding to slope T(z) ranges between −90 and +90 degrees; if the angle becomes less than −90 degrees or greater than 90 degrees at any point, value At_max_1 is decreased and calculation of Ac(z) is reiterated until an angle value belonging to a given [γ1; γ2] range is obtained.

The invention also relates to a device which imparts energy to receives energy from a multiphase fluid comprising at least one gas phase and at least one liquid phase, the device comprising at least one housing and at least one impeller as described above.

According to another embodiment, the device comprises at least one impeller provided with an additional element placed on the outer shell of the vanes to limit leakage between the impeller inlet and outlet.

The impeller or the device according to the invention are particularly well-suited for petroleum effluent pumping.

BRIEF DESCRIPTION OF THE DRAWINGS

Other features and advantages of the invention will be clear from reading the description hereafter of several non limitative embodiment examples, with reference to the accompanying simplified drawings wherein.

DESCRIPTION OF THE PREFERRED EMBODIMENTS OF THE INVENTION

Figure 1:
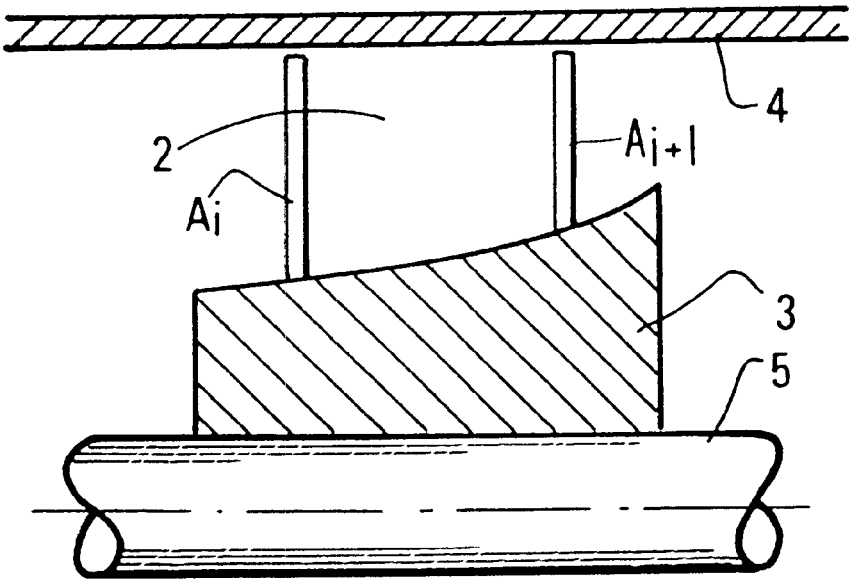
FIG. 1 diagrammatically shows a device according to the prior art.

FIG. 1 shows a helical axial flow impeller 1 with a convergent channel 2, a rectilinear outer channel shell and an inner shell (substantially constant radius of curvature in the meridian plane). The impeller is equipped with several vanes Ai or blades secured to a boss 3, the channel intended for the multiphase fluid being defined by the boss, two successive vanes Ai, Ai+1 and housing 4. The boss is secured to a shaft 5.

The shape of the boss and the shape of the outer shell can be substantially identical to those given in French Patent 2,665,224.

Figure 2:
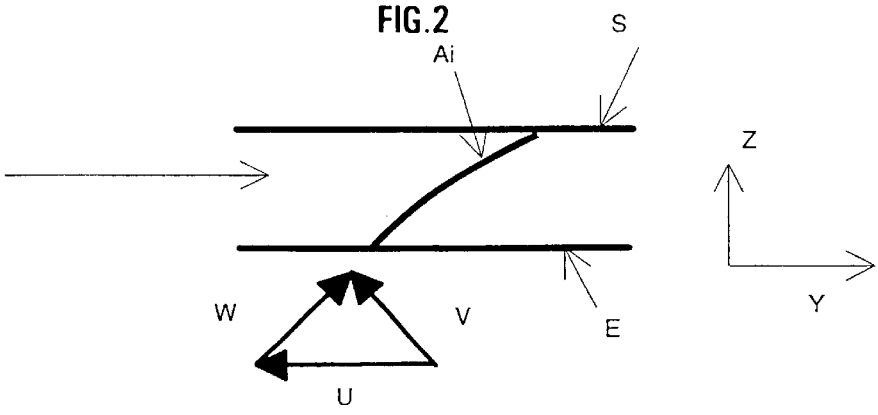
FIGS. 2 and 3 show the velocities and the main components of the radial acceleration.
Figure 3:
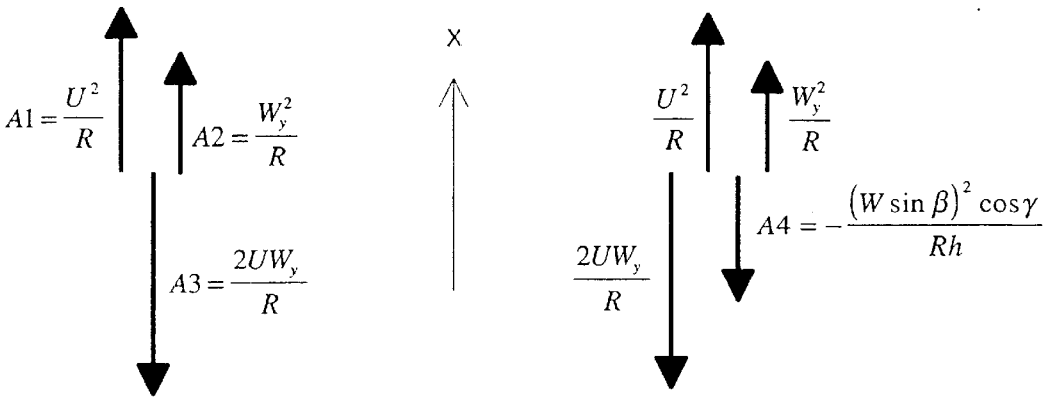

FIGS. 2 and 3 illustrate that the velocities of the multiphase flow and the main components of the radial acceleration are an important parameter in the phase separation process during operation of an impeller on a two-phase flow regime.

FIG. 2 shows the outline of a vane Ai of a helical axial flow impeller in a radial direction (along a radius of the impeller), and the triangle of velocities at the impeller inlet. Velocities $\vec{U}$, $\vec{V}$ and $\vec{W}$ respectively represent the peripheral driving velocity, the absolute velocity of flow in a fixed reference system (X-radial, Y-tangential, Z-axial) and the relative velocity of flow in a moving reference system that of the impeller for example, with the vectorial relation: $\vec{U}=\vec{V}+\vec{W}$.

In FIG. 2, Ai represents a vane of an impeller, E the impeller inlet and S the impeller outlet.

FIG. 3 represents the main components of the radial acceleration taking an active part in the phase separation process during operation of an impeller on a two-phase flow regime.

The various accelerations are for example represented as follows:

A1 is the centrifugal driving acceleration in the fixed reference system (X-radial Y-tangential, Z-axial) directed towards the positive X (outside of the impeller),

A2 is the centrifugal acceleration of flow in the moving reference system, also directed towards the positive X,

A3 is the Coriolis acceleration.

A4 is the centrifugal acceleration resulting from the curvature of the channel in the meridian plane. It is this component that notably allows defining the specific feature of the impeller according to the invention.

The other components of the radial acceleration are not shown in the FIG. 3 for simplification reasons. They include the radial component A5 of the centrifugal acceleration created as the flow runs along the vane of the impeller, and the radial component A6 of the acceleration generated by the change of area as the flow runs through the channel.

Generally speaking, at least three radial accelerations can be considered.

Anc is the acceleration of a non-curved channel in the meridian plane (A1+A2+A3+A5+A6), these values being detailed above, Ac=the centrifugal acceleration resulting from the curvature of the channel in the meridian plane or A4, and $A_\gamma$=Anc+Ac.

Under the expression "channel curvature", and within the scope of this invention, at least 3 characteristic shells can be distinguished in the meridian plane, at a given axial position:

Cint=inner shell of the channel closed by the boss,

Cmoy=mean shell of the channel corresponding to the mean path followed by the fluid flow, Cext=outer shell of the channel; this shell can be materialized or not by the inner wall of an outer cover.

Figure 4:
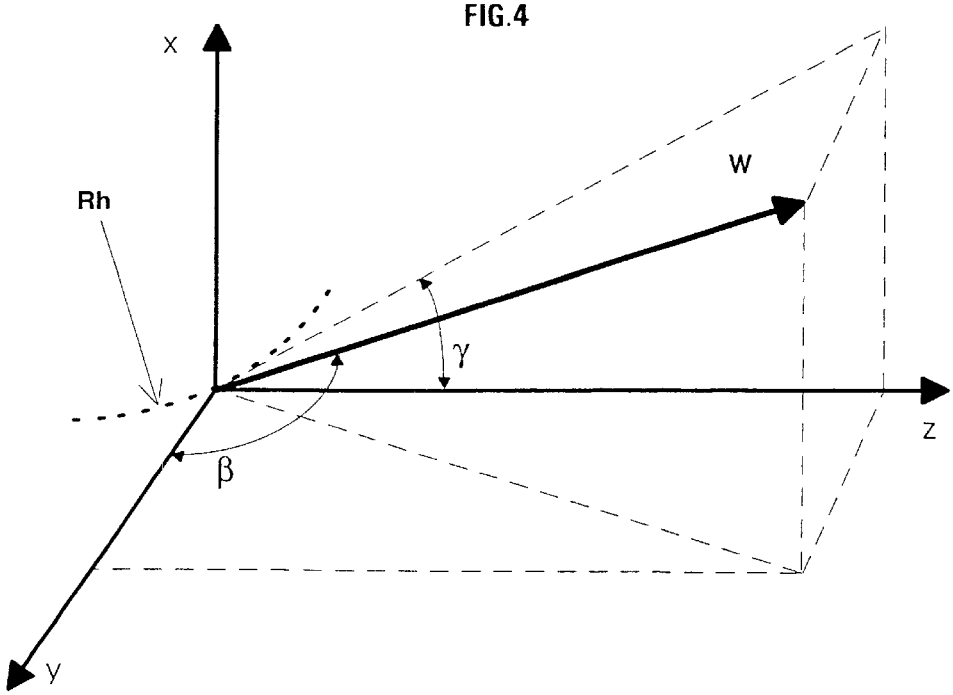
FIG. 4 shows the angles of the velocity of flow.

In FIG. 4, index y designates a tangential component, angles β and γ respectively represent the position of the relative velocity vector in relation to the Y-axis and the position of the velocity vector projection in the plane XOZ in relation to the Z-axis.

In FIG. 4, Rh designates the mean radius of curvature.

The Coriolis acceleration, A3, is directed towards the negative X (case of FIG. 4) when the product of $\vec{U}$ by the tangential component $\vec{W}$ is negative. It is directed towards the positive X in the opposite case.

The centrifugal acceleration A4 exerted on the multiphase fluid is directed towards the negative X in the case of a curvature having a positive second derivative and towards the positive X in the opposite case.

The centrifugal acceleration A5 exerted on the multiphase fluid is directed towards the negative or positive X according to the shape of the vane. The radial component is generally low in relation to the other accelerations.

The acceleration A6 exerted on the multiphase fluid is directed towards the negative or positive X according to the orientation of the channel and to the area variation in the direction of displacement of the flow. The radial component is generally low in relation to the other accelerations.

When radial components A5 and A6 cannot be disregarded, they are taken into account for calculation of Anc.

The specific features of the impeller which are in accordance with the present invention are defined by means of the following: in order to obtain high performance when energy is to be imparted to a multiphase fluid, the resulting acceleration exerted on the phases presenting density differences must be low.

The mean radius of curvature of the channel is defined so as to prevent separation of the liquid phase and of the gas phase for example by implementing the stages of the method described hereafter.

SUMMARY OF DEFINITIONS AND CHARACTERISTICS SPECIFIC TO THE PRIOR ART

A point T(z) of the mean curvature of the channel is associated with the velocity angles defined above (FIG. 4).

Figure 5:
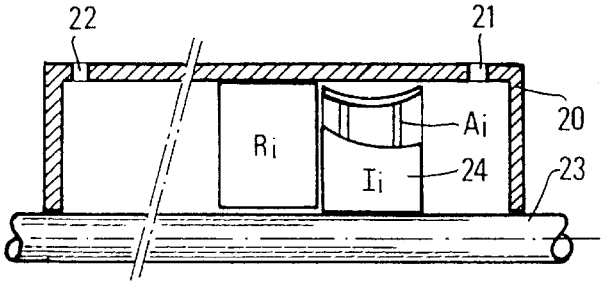
FIG. 5 shows an example of a pumping device comprising at least one impeller according to the invention.

FIG. 5 diagrammatically shows, in axial section, a particular non-limitative example of a pumping assembly comprising at least one impeller having a suitable mean radius of curvature.

Such an assembly is for example used for pumping a multiphase petroleum effluent.

In this example, reference number 20 designates a housing in which several compression cells are arranged. Housing 20 comprises at least one inlet port 21 and at least one outlet port 22 for the multiphase fluid whose energy is to be increased.

A compression cell comprises for example an impeller li whose function is to increase the energy of the fluid and a diffuser Ri, i corresponding to the stage of the compression cell. The impeller comprises several vanes Ai or blades secured to a boss 24.

The impellers are secured to a shaft 23 on which they are held in place by means known in the art.

In general, a compression cell comprises a pair consisting of an impeller and a diffuser. It is however possible, without departing from the scope of the invention, to have a compression cell only including an impeller li.

Diffuser Ri following an impeller li will be selected for example to meet the following requirements:

- the inlet angle of diffuser RI is substantially equal to the outlet angle of impeller li in the meridian plane, and
- the outlet angle of diffuser Ri is substantially equal to the inlet angle of impeller li+1 in the meridian plane so as to avoid any hydraulic maladjustment between the rotating elements and the stationary elements.

Parameters $\vec{U}$, $\vec{V}$, $\vec{W}$, β, and γ, as well as their components, depend on the point T(z) considered on the curvature of the channel. An impeller has a length Lt which is considered to be the unit length hereafter, the value of z indicating the position of a point P on the radius of curvature ranging from 0 to 1.

In a channel according to the prior art, radial acceleration A4 does not vary substantially between the inlet and the outlet of the impeller (substantially constant radius of curvature of the boss) and, in certain zones of the channel, it is either too high or too low, considering the different values taken by the radial accelerations other than A4 in the axial direction. The shape of the mean shell of the channel (Cmoy) is therefore not well suited for phase separation limitation in the channel. Phase separation limitation by adapting the shape of the mean shell to the variations, in the axial direction, of the radial accelerations is described hereafter.

For simplification reasons, accelerations A5 and A6 are not discussed hereafter. These accelerations can however be included in Anc(z) without changing the procedure for calculating radius of curvature Rh(z) at point T(z).

Anc(z) defined above (corresponding to a mean shape of rectilinear shell Cmoy) satisfies the relation:

$$Anc(z) = \frac{U^2}{R} + 2\frac{U}{R}Wy + \frac{W_y^2}{R} = \frac{1}{R}(U + W_y)^2 \tag{1}$$

When the Coriolis acceleration is directed towards the negative X, partial balancing of the accelerations (between A1 and A2 on the one hand and A3 on the other) occurs, as shown by the left-hand member of Equation (1). Total balance (corresponding to a zero resulting acceleration) between these three accelerations is obtained when $W_y$−U, as shown by the right-hand member of Equation (1).

Energy transfer (expansion or compression) from the rotor to the fluid can only be obtained when a momentum change takes place between the inlet and the outlet, as shown by the Eulerian equation $$H=U_2V_{2y}-U_1V_{1y} \tag{2}$$

where 1 and 2 denote the impeller inlet and outlet conditions. It follows from Equations (1) and (2) that an acceleration unbalance tends to develop when the energy transfer increases.

Method for Determining the Mean Radius of Curvature of the Fluid Flow Channel to Limit Separation of the Liquid Phase and of the gas Phase In relation to the prior art, an additional parameter, centrifugal acceleration A4, is taken into account.

In the radial direction, accelerations of lower amplitude, A5 and A6, are not considered with four accelerations being taken into account in the phase separation mode. The sum of these accelerations is $$\frac{U^2}{R} + 2\frac{U}{R}Wy + \frac{W_y^2}{R} + A4 = \frac{1}{R}(U + W_y)^2 + A4 = A_\gamma(z) \tag{3}$$

with:

$$Ac(z) = A4 - \frac{(W\sin\beta)^2\cos\gamma}{Rh(z)}$$

the centrifugal acceleration due to the curvature of the channel in the meridian plane.

When acceleration A4 is directed towards the negative X, the acceleration unbalance corresponding to Equation (1) is reduced. A lower phase separation effect results therefrom, and consequently a higher efficiency during a multiphase energy conversion. Total balancing (corresponding to a zero resulting acceleration) between these various accelerations is more readily obtained in the presence of acceleration A4 (equation 3) than in the absence of A4 (equation 1), even when $W_y$, is different from −U.

Calculation Method

A starting point is from an impeller having a known initial radius of curvature, with the value Anc(z) being known for all the values of z.

An attempt is made to minimize value $A_\gamma$. The new mean radius of curvature of the channel taken in a meridian plane is for example determined as follows:

- with Z=0 defining the channel inlet and Z=1 defining the outlet, point $Z_0$ corresponding to the minimum value of Anc(z) is determined,
- with $Z=Z_0$, a zero slope ($T(Z_0)=0$) is for example selected in the meridian plane for shell Cmoy. Without departing from the scope of the invention, it is possible to take a value different from 0 without changing the procedure for calculating Rh(Z),
- a starting value At_max=At_max_1 valid for all the values of z is selected, Ac(z) is calculated.

The known value of Anc(z) is compared with the value of At_max.

Two cases, a) and b), may arise:

a) Anc(z)<=At_max, then Ac(z) can have any value ranging between 0 and At_max-Anc(z), with $$Rh(z) = -\frac{(W \sin\beta)^2 \cos\gamma}{Ac(z)}$$

and one of these values is selected.

Under this condition, Rh(z) is negative and the concavity of shell Cmoy is directed towards the negative X, b) Anc(z)>At_max, then Ac(z)=At_max−Anc(z), with $$Rh(z) = -\frac{(W \sin\beta)^2 \cos\gamma}{Ac(z)}$$

Under this condition Rh(z) is positive and the concavity of shell Cmoy is directed towards the positive X.

By going for example from point $Z_0$ to the channel inlet, a slope $T_1$, is obtained at the inlet for shell Cmoy and, similarly for example from point $Z_0$, to the outlet, with a slope $T_2$, at the outlet. The curvature of the impeller is thus determined at any point. An angle value $_\gamma$j, with j=1 for the impeller inlet and j=2 for the impeller outlet, corresponds to a slope Tj. Values $T_1$ and $T_2$, corresponding to the two angle values γ1 and γ2 are thus obtained.

At any point, angle γ corresponding to slope T(z) must range between −90 and +90 degrees. During the calculation procedure, if the angle becomes less than −90 degrees or greater than 90 degrees at any point, the initial value At_max is decreased and calculation is reiterated until an angle value ranging between −90° and 90°, [γ1, γ2], is obtained.

For reasons specific to the function of the impeller (compression, expansion or other specific applications), if the absolute values of the slopes are too high, the initial value of At_max is decreased and calculation is reiterated until an angle value ranging between −90° and 90° is obtained.

It is possible to select different values for At_max at the inlet and at the outlet of the channel.

According to the nature of the impellers and to their function (compression, expansion or other applications), it is possible to define values for angles γ1, γ2 corresponding to slopes $T_1$ and $T_2$, that are different from the aforementioned values −90°, 90°.

EXAMPLE

A—Numerical Example Concerning the Curvature of the Channel in the Meridian Plane and the Corresponding Radial Acceleration Reduction This example is for a helical axial flow impeller spinning at 3000 rpm. The mean distance from the center of the channel to the axis of rotation, in the middle of the impeller is equal to 0.114 m.

| Axial position | Impeller inlet | Impeller middle | Impeller outlet |
|---|---|---|---|
| Radius of curvature of the channel in the meridian plane | 0.060 m | 2.00 m | 0.035 m |

-continued

| Axial position | Impeller inlet | Impeller middle | Impeller outlet |
|---|---|---|---|
| Beta angle | 0.300 rad | 0.224 rad | 0.140 rad |
| Gamma angle | −0.140 rad | 0.00 rad | 0.340 rad |
| Relative velocity W | 26.3 m/s | 36.3 m/s | 52.6 m/s |
| Driving velocity U | 35.7 m/s | 35.7 m/s | 35.7 m/s |
| Acceleration Ac | −990 $m/s^2$ | −30 $m/s^2$ | −1510 $m/s^2$ |
| Accelerations Anc | 1000 $m/s^2$ | 0 $m/s^2$ | 2350 $m/s^2$ |
| Accelerations $A_T$ | 10 $m/s^2$ | −30 $m/s^2$ | 2340 $m/s^2$ |

The values of the table are applicable at the center of the channel at a given axial position. These are mean values concerning the angles, the velocities and the radii. The values relative to accelerations are not mean values but the values corresponding to the mean angle, velocity and radius values.

The table shows that, in the case of a rectilinear channel in the meridian plane, the energy transformation generates a residual radial acceleration that ranges from the order of 0 $m/s^2$ (in the channel middle) to 1000 $m/s^2$ near the inlet to 2340 $M/s^2$ near the outlet. The presence of channel curvatures in a meridian plane at the impeller inlet and outlet allows a residual radial acceleration of the order not to exceed 800 $m/s^2$ (value corresponding to the mean angle, velocity and radius values at the impeller outlet).

The curvature of the channel is adjusted from the inlet to the outlet so as to minimize the residual acceleration as shown in the table above: small radius of curvature at the inlet, increasing in the direction of the impeller middle, then decreasing again in the direction of the impeller outlet. Two geometric progression laws can for example be used for the variations of the radius of curvature according to the axial position: a first one for the upstream part, a second one for the downstream part.

According to another embodiment, the impeller comprising a channel with a radius of curvature defined according to the aforementioned steps is provided with a cover whose slope on the outer shell at the end of the cover is determined so as to limit leakage between the impeller inlet and outlet.

The shape of this cover is for example obtained by implementing the steps of the method described in French Patent Application 98/16,521 entitled "Two-phase helical mixed flow impeller with curved fairing".

For example, for a compression impeller.

the value of angle γ2 is determined in this case for a predetermined outer shell Cext, the the value of the cover angle to be given at the impeller outlet is determined by using the value of γ2 as the initial value for $\theta_2$, defined below and by implementing for example the following stages:

The starting point is from the following data:

the rotating speed of the impeller, N, expressed in revolutions per second, the distance from the outer part of the cover (point C) to the axis of rotation, Rc, at the impeller outlet, $Rc_2$, the angle formed by the tangent of the outer surface of the cover, at point C, with the axis of rotation in the meridian plane at the impeller outlet, $\theta_2$, the radial clearance between the cover and the stationary part, at the outlet, $J_2$, the pressure at the impeller outlet, $P_2$, the pressure at the impeller inlet, $P_1$, Leakage will appear at a rotating speed N, a radius $Rc_2$, and an angle $\theta_2$. The leakage tends to decrease when angle $\theta_2$ increases.

At first, the outer shape of the cover is assumed to be identical to the outer shape of the channel.

The following parameters are for example calculated at the impeller outlet.

Given parameters

Clearance height in a direction perpendicular to the cover surface:

$$Jp_2=J_2/\cos(\theta_2).$$

Surface of revolution of the clearance perpendicular to the cover surface:

$$Sj_2=2*\pi*Rc_2*Jp_2$$

Determination of the force exerted by the pressure:

Force exerted by the pressure from the outlet to the inlet of the impeller, in the vicinity of the clearance:

$$FP_2=Sj_2*(P_2-P_1)$$

Centrifugal acceleration at radius $Rc_2$.

$$Ax_2=(2*\pi*N)^2*Rc_2.$$

Determination of the force exerted by the centrifugal acceleration on the fluid mass.

The component of the centrifugal acceleration tangentially to the cover is:

$$Ac_2=Ax_2*\sin(\theta_2).$$

The volume of revolution V defined by the outer surface of the cover, a shell parallel to this surface taken at a distance $Jp_2$, over an axial length Lz, is defined by $$V=2*\pi*Rmz*Lz*Jp2,$$

Rmz being the mean outer radius of the cover over length Lz.

The mass of the fluid volume contained in the corresponding volume of revolution is:

$$M=V*\rho o$$

where ρo is the density of the liquid.

The force exerted by the centrifugal acceleration on the fluid mass M contained in the volume of revolution is:

$$Fc=AC_2*M=Ax_2*\sin(\theta_2)*2*\pi*Rmz*Lz*JP_2*\rho o$$

The value of the slope to be given to the part of the cover situated at the impeller outlet is deduced from these two force values and from the balancing condition sought for limiting leaks. The value of the slope is given by means of value Lz or of the value of angle γ.

The value of Lz is for example deduced from the previous equality:

$$Lz=Rc_2*(P_2-P_1)/Rmz/Ax_2/\sin(\theta_2)/\rho.$$

A determination is made the value of Lz is below a maximum value Lmax, if $Lz \leqq Lmax$, the corresponding value of angle $\theta_2$ is acceptable, if Lz>Lmax, the angle value is increased until a value of Lz less than or equal to Lmax is obtained.

The value of Lmax is for example equal to about 20% of the axial length of the impeller, Lt.

Without departing from the scope of the invention, this method can be applied to an expansion impeller by starting from the value of angle γ1 and by determining the value of $\theta_1$. In this case, the slope is determined for the inlet of the cover, a high-pressure point.

In all the examples given above, the number, the thickness and the material of the vanes, as well as the thickness and the material of the cover are determined so as to ensure integrity of the system, considering the mechanical stresses exerted on the inner parts of the impeller and resulting mainly from the rotating speed and the torque transmitted. These calculating methods are known in the art and are therefore not detailed.

The number, the thickness and the angle β of the vanes are determined on a hydraulic plane according to the state of the art or to prior patents.

What is claimed is:

1. An impeller which imparts energy to or receives energy from a multiphase fluid incluiding at least one gas phase and at least one liquid phase, the impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis.

2. An impeller as claimed in claim 1, wherein for an initial value $Z_0$ a value is selected corresponding to a minimum value $Anc(Z_0)$.

3. An impeller as claimed in claim 2, wherein a value of the angle $\gamma 1$ is selected to be one of equal to or different from a value of the angle $\gamma 2$.

4. An impeller as claimed in claim 1, comprising an additional element placed on an outer shell of the vanes to limit leakage between the inlet and the outlet, the additional element being located in a vicinity of a high-pressure end of the impeller.

5. A method of manufacturing an impeller as claimed in claim 1, wherein:

an initial radius of curvature of the impeller is known.

6. A device which imparts energy or receives energy from a multiphase fluid including at least one impeller each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle $\gamma 1$ and $T_2$ being obtained at the outlet, corresponding to an angle $\gamma 2$ with γ being an angle between a projection of a velocity vector in an X0Y plane and the Z axis.

7. A method of pumping petroleum effluent using at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle $\gamma 1$ and $T_2$ being obtained at the outlet, corresponding to an angle $\gamma 2$ with γ being an angle between a projection of a velocity vector in an X0Y plane and the Z axis; and imparting energy to the petroleum effluent using the at least one impeller.

8. An impeller as claimed in claim 2, comprising an additional element placed on an outer shell of the vanes to limit leakage between the inlet and outlet, the additional element being located in a vicinity of a high-pressure end of the impeller.

9. An impeller as claimed in claim 3, comprising an additional element placed on an outer shell of the vanes to limit leakage between the inlet and outlet, the additional element being located in a vicinity of a high-pressure end of the impeller.

10. A device which imparts energy or receives energy from a multiphase fluid including at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis, and wherein for an initial value $Z_0$ a value is selected corresponding to a minimum value Anc($Z_0$).

11. A device which imparts energy or receives energy from a multiphase fluid including at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis, and wherein for an initial value $Z_0$ a value is selected corresponding to a minimum value Anc($Z_0$).

12. A device which imparts energy or receives energy from a multiphase fluid including at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis; and an additional element is placed on an outer shell of the vanes to limit leakage between the inlet and the outlet, the additional element being located in a vicinity of a high-pressure end of the impeller.

13. A device which imparts energy or receives energy from a multiphase fluid including at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis;

wherein for an initial value $Z_0$ a value is selected corresponding to a minimum value Anc($Z_0$); and an additional element is placed on an outer shell of the vanes to limit leakage between the inlet and outlet, the additional element being located in a vicinity of a high-pressure end of the impeller.

14. A device which imparts energy or receives energy from a multiphase fluid including at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis; and wherein for an initial value $Z_0$ a value is selected corresponding to a minimum value Anc($Z_0$);

for a value of the angle γ1 is selected to be one of equal to or different from a value of the angle γ2; and an additional element is placed on an outer shell of the vanes to limit leakage between the inlet and outlet, the additional element being located in a vicinity of a high-pressure end of the impeller.

15. A method of pumping petroleum effluent using at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis, and wherein for an initial value $Z_0$ a value is selected corresponding to a minimum value Anc($Z_0$), and energy is imparted to the petroleum effluent using the at least one impeller.

16. A method of pumping petroleum effluent using at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis; and for an initial value $Z_0$ a value is selected corresponding to a minimum value Anc($Z_0$);

a value of the angle γ1 is selected to be one of equal to or different from a value of the angle γ2; and energy is imparted to the petroleum effluent using the at least one impeller.

17. A method of pumping petroleum effluent using at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis; and an additional element is placed on an outer shell of the vanes to limit leakage between the inlet and the outlet, the additional element being located in a vicinity of a high-pressure end of the impeller; and energy is imparted to the petroleum effluent using an the at least one impeller.

18. A method of pumping petroleum effluent using at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis;

wherein for an initial value $Z_0$ a value is selected corresponding to a minimum value Anc($Z_0$); and an additional element is placed on an outer shell of the vanes to limit leakage between the inlet and outlet, the additional element being located in a vicinity of a high-pressure end of the impeller; and energy is imparted to the petroleum effluent using the at least one impeller.

19. A method of pumping petroleum effluent using at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis; and wherein for an initial value $Z_0$ a value is selected corresponding to a minimum value Anc($Z_0$);

a value of the angle γ1 is selected to be one of equal to or different from a value of the angle γ2; and an additional element is placed on an outer shell of the vanes to limit leakage between the inlet and outlet, the additional element being located in a vicinity of a high-pressure end of the impeller; and energy is imparted to the petroleum effluent using the at least one impeller.

20. A method of pumping petroleum effluent using including at least one impeller, each impeller comprising an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W \sin\beta)^2 \cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W \sin\beta)^2 \cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis, and imparting energy to the petroleum effluent using the device.

21. A method of pumping petroleum effluent using a device which imparts energy or receives energy from a multiphase fluid including at least one impeller, an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W \sin\beta)^2 \cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W \sin\beta)^2 \cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis; and wherein for an initial value $Z_0$ a value is selected corresponding to a minimum value Anc($Z_0$).

22. A method of pumping petroleum effluent using a device which imparts energy or receives energy from a multiphase fluid including at least one impeller, each impeller comprising:

an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W \sin\beta)^2 \cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W \sin\beta)^2 \cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis;

an additional element is placed on an outer shell of the vanes to limit leakage between the inlet and the outlet, the additional element being located in a vicinity of a high-pressure end of the impeller; and energy is imparted to the petroleum effluent using the device.

23. A method of pumping petroleum effluent using a device which imparts energy or receives energy from a multiphase fluid including at least one impeller, each impeller comprising:

an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis ;

wherein for an initial value $Z_0$ a value is selected corresponding to a minimum value Anc($Z_0$);

an additional element is placed on an outer shell of the vanes to limit leakage between the inlet and outlet, the additional element being located in a vicinity of a high-pressure end of the impeller; and energy is imparted to the petroleum effluent using the device.

24. A method of pumping petroleum effluent using a device which imparts energy or receives energy from a multiphase fluid including at least one impeller, each impeller comprising:

an inlet and an outlet, at least one flow channel including at least one boss and two successive vanes, with the impeller having an axial length Lt and a mean radius of curvature Rh(z), taken in a meridian plane, the mean radius of curvature being determined from a known initial radius of curvature by implementing at least the following steps:

selecting a value $Z_0$ at an axial position with a corresponding value of Anc(z) being known with Anc(z) being an acceleration of a non-curved channel in the meridian plane along a Z axis of the non-curved channel;

selecting a starting value At_max valid for all the values of z;

calculating Ac(z) corresponding to centrifugal acceleration resulting from curvature of the channel in the meridian plane;

comparing the known value of Anc(z) with the value of At_max so that:

a) if Anc(z)<=At_max, then Ac(z) can have any value ranging between 0 and At_max−Anc(z), with $$Rh(z) = -\frac{(W\sin\beta)^2\cos\gamma}{Ac(z)},$$

wherein W is a relative velocity vector of the multiphase fluid and β is an angle between a Y axis and the relative velocity vector in an X, Y, and Z axis coordinate system, and one of the values of Ac(z) is selected, b) if Anc(z)>At_max, then Ac(z)=At_max−Anc(z), with $$Rh(z) = -\frac{(W\sin\beta)^2\cos\gamma}{Ac(z)}, \text{ and}$$

c) determining a curvature and a slope from the impeller inlet to the impeller outlet by starting from a point T on the curvature of the channel with $T_1$ being obtained at the inlet, corresponding to an angle γ1 and $T_2$ being obtained at the outlet, corresponding to an angle γ2 with γ being an angle between a projection of a velocity vector in an X0Y plane and the Z axis; and wherein a value of the angle γ1 is selected to be one of equal to or different from a value of the angle γ2; and for an initial value $Z_0$ a value is selected corresponding to a minimum value Anc($Z_0$); and energy is imparted to the petroleum effluent using the device.

* * * * *